US007534749B2

(12) United States Patent
Egawa et al.

(10) Patent No.: US 7,534,749 B2
(45) Date of Patent: May 19, 2009

(54) LUBE BASE OIL AND LUBRICATING OIL COMPOSITION

(75) Inventors: Tatsuya Egawa, Chiba (JP); Toshiyuki Tsubouchi, Chiba (JP); Masahiro Yoshimoto, Chiba (JP); Junko Yoshimoto, legal representative, Chiba (JP); Yoshio Hironaka, Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 430 days.

(21) Appl. No.: 10/540,569

(22) PCT Filed: Dec. 24, 2003

(86) PCT No.: PCT/JP03/16597

§ 371 (c)(1),
(2), (4) Date: Dec. 22, 2005

(87) PCT Pub. No.: WO2004/058928

PCT Pub. Date: Jul. 15, 2004

(65) Prior Publication Data

US 2006/0166844 A1 Jul. 27, 2006

(30) Foreign Application Priority Data

Dec. 24, 2002 (JP) ..... 2002-372397

(51) Int. Cl.
*C10M 107/34* (2006.01)

(52) U.S. Cl. ..... 508/580

(58) Field of Classification Search ..... 508/580
See application file for complete search history.

(56) References Cited

U.S. PATENT DOCUMENTS 2,605,292 A 7/1952 Shugar et al.
4,790,957 A * 12/1988 Mach et al. ..... 508/482

FOREIGN PATENT DOCUMENTS

| | | |
|---|---|---|
| EP | 0 170 076 A1 | 2/1986 |
| EP | 0 992 570 | 4/2000 |
| JP | 02-300293 | 12/1990 |
| JP | 08-259974 | 10/1996 |
| JP | 09-100480 | 4/1997 |
| JP | 10-324883 | 12/1998 |
| JP | 2000-044971 | 2/2000 |
| JP | 2002-146381 | 5/2002 |
| JP | 2004-051720 | 2/2004 |

* cited by examiner

*Primary Examiner*—Walter D Griffin
*Assistant Examiner*—Frank C Campanell
(74) *Attorney, Agent, or Firm*—Oblon, Spivak, McClelland, Maier & Neustadt, P.C.

(57) ABSTRACT

The invention provides a lube base oil other than silicone oil having a kinematic viscosity of 12 $mm^2/s$ or below at 40° C., exhibiting, in Noack test (250° C., 1 hr), an evaporation loss of 30 mass % or below and/or a flash point of 200° C. or higher, and exhibiting an aniline point of 60° C. or higher. There is also provides a lubricating oil composition comprising the lube base oil mixed with at least one additive selected from the group consisting of an antioxidant, a viscosity index improver, a detergent dispersant, a friction reducing agent, a metal inactivator, a pour point depressant, an abrasion resisting agent, a defoamer, and an extreme-pressure additive. The lube base oil and the lubricating oil composition realize reduction of evaporation loss despite being of low viscosity and excellent compatibility with organic materials.

16 Claims, 2 Drawing Sheets

LUBE BASE OIL AND LUBRICATING OIL COMPOSITION

TECHNICAL FIELD

The present invention relates to a lube base oil and to a lubricating oil composition. More particularly, the invention relates to a lube base oil and to a lubricating oil composition, which realize reduction of evaporation loss despite being of low viscosity and excellent compatibility with organic materials.

BACKGROUND ART

In recent years, internal combustion engines have been required to attain fuel savings, and engine oil having lower viscosity is employed in order to satisfy the requirement. Conventionally, viscosity of engine oil has been lowered through appropriately blending high-viscosity oil with low-viscosity oil. Low-viscosity oil readily evaporates at high temperature in an engine, and is gradually discharged with exhaust gas. Thus, such an engine oil comes to have higher viscosity, thereby impairing fuel economy. Meanwhile, in order to assess such a drawback of conventional engine oil, the Noack test has been employed for providing an index for volatility. As a result, a lube base oil satisfying low volatility has been attained and come to be used more frequently.

Ester-based oil compositions are known to be lubricating oil compositions which have low viscosity and exhibit low evaporation loss. However, these compositions have high polarity and have adverse effects on organic materials, such as inducing swelling. For example, when such an ester-based oil composition is used in an engine oil, problematic swelling of a sealing material and-other materials made of rubber occurs. When the composition is used in an oil for hydraulic bearings or oilless bearings, plastic materials are adversely affected. In addition, these ester-based oil compositions have poor solubility with respect to additives, which is also problematic.

Silicone oil serves as a lube base oil which has low viscosity and exhibits low evaporation loss, but has problems of poor lubricity and high cost. Poly(α-olefin) is known to be a base oil which has low viscosity and exhibits low evaporation loss. However, a poly(α-olefin) categorized in a viscosity grade of 4 $mm^2/s$ (100° C.) is unsatisfactory in terms of low viscosity and a poly(α-olefin) categorized in a viscosity grade of 2 $mm^2/s$ (100° C.) is unsatisfactory in terms of low volatility.

Japanese Patent Application Laid-Open (kokai) No. 10-324883 discloses a lube base oil which contain a compound having an ether bond and exhibits a viscosity index and a pour point falling within a limited range. However, in order to satisfy further fuel cost saving performance, a lube base oil having lower viscosity and exhibiting small evaporation loss is demanded.

DISCLOSURE OF THE INVENTION

The present invention has been conceived with the aim of solving the aforementioned problems. Thus, an object of the present invention is to provide a lube base oil and lubricating oil composition which realize reduction of evaporation loss despite being of low viscosity and excellent compatibility with organic materials. Another object of the invention is to provide a lubricating oil composition containing the lube base oil.

The present inventors have carried out extensive studies in order to attain the aforementioned objects, and have found that the aforementioned objects can be attained through causing kinematic viscosity, evaporation loss and/or flash point, and aniline point of the base oil to fall within specific corresponding ranges. The present invention has been accomplished on the basis of this finding.

Accordingly, the present invention provides a lube base oil other than silicone oil having a kinematic viscosity of 12 $mm^2/s$ or below at 40° C., exhibiting, in Noack test (250° C., 1 hr), an evaporation loss of 30 mass % or below and/or a flash point of 200° C. or higher, and exhibiting an aniline point of 60° C. or higher.

There is also provides a lubricating oil composition comprising the lube base oil mixed with at least one additive selected from the group consisting of an antioxidant, a viscosity index improver, a detergent dispersant, a friction reducing agent, a metal inactivator, a pour point depressant, an abrasion resisting agent, a defoamer, and an extreme-pressure additive.

BEST MODES FOR CARRYING OUT THE INVENTION

Figure 1:
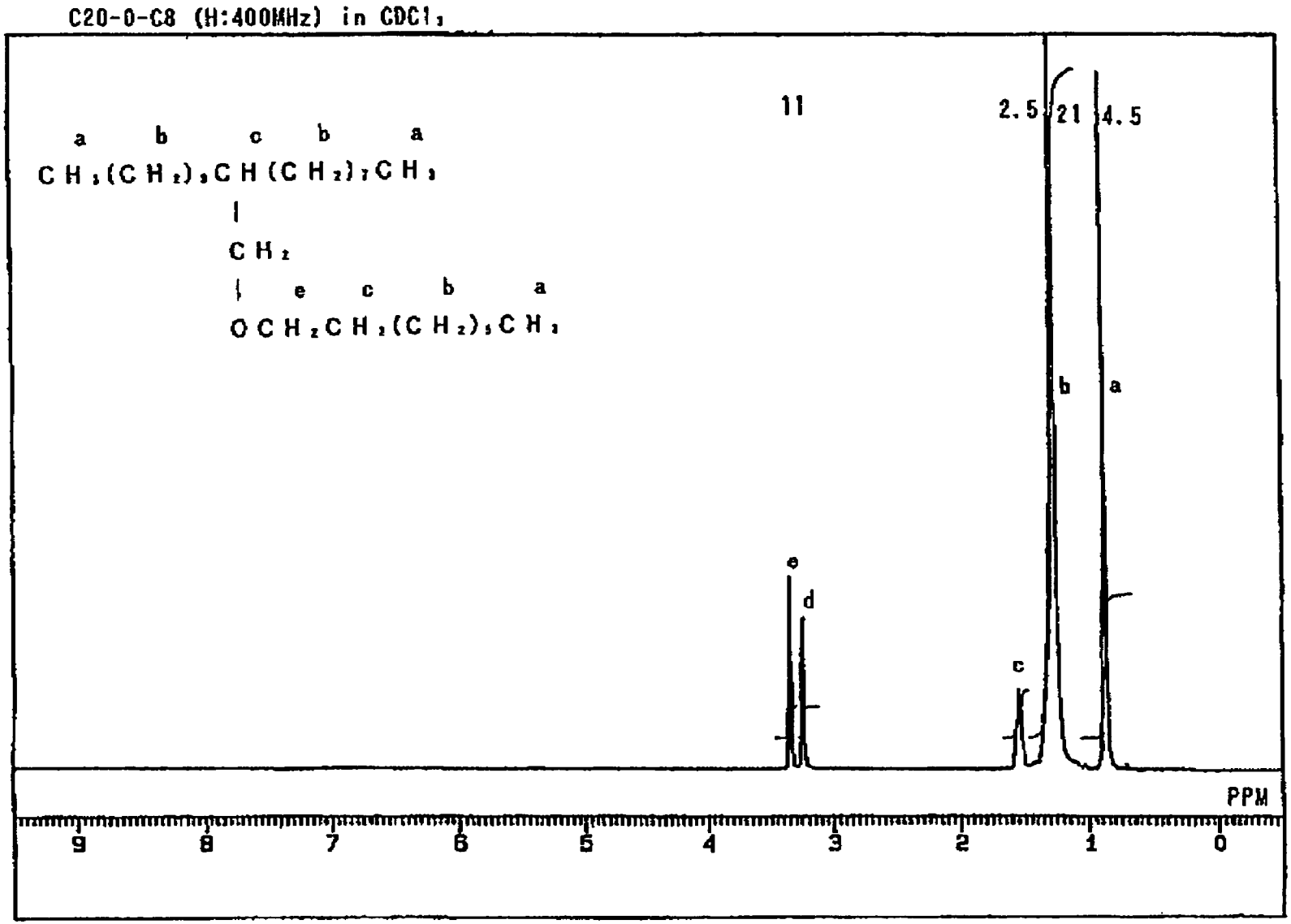
FIG. 1 shows a $^1$H-NMR spectrum of the compound produced in Production Example 1.

The lube base oil of the present invention must satisfy at least the following conditions (i) to (iii).

The lube base oil of the present invention has (i) a kinematic viscosity at 40° C. of 12 $mm^2/s$ or below, preferably 11 $mm^2/s$ or below, more preferably 10 $mm^2/s$ or below. When the kinematic viscosity is in excess of 12 $mm^2/s$, the lube base oil becomes excessively viscous, thereby failing to attain sufficient fuel-cost-saving effect.

The lube base oil of the present invention exhibits (ii) in Noack test (250° C., 1 hr), an evaporation loss of 30 mass % or below and/or a flash point of 200° C. or higher (i.e., fourth class petroleum). In Noack test (250° C., 1 hr), the evaporation loss is preferably 25 mass % or below, more preferably 15 mass % or below. When the evaporation loss is in excess of 30 mass %, the amount of base oil lost through evaporation during use thereof increases, thereby shortening the service life of the lube oil. The flash point is preferably 210° C. or higher, more preferably 220° C. or higher. When the flash point is lower than 200° C., the amount of base oil lost through evaporation during use thereof increases, thereby shortening the service life of the lube oil.

In some cases, the Noack test fails to determine actual volatility due to effects such as oxidation-induced decomposition. Such effects may be suppressed through addition of an anti-oxidant or a similar substance. However, in the present invention, volatility of the base oil is determined through employment of the Noack test results and flash point in combination.

The lube base oil of the present invention exhibits (iii) an aniline point of 60° C. or higher, preferably 80° C. or higher, more preferably 90 to 110° C. When the aniline point is lower than 60° C., compatibility with organic materials is impaired. That is, swelling of organic materials (e.g., plastics and rubber) used in an apparatus occurs. When the aniline point is in excess of 110° C., organic materials may be shrunk.

The lube base oil of the present invention preferably has a viscosity index, as measured in accordance with JIS K 2283, of 100 or higher, more preferably 120 or higher.

The lube base oil of the present invention preferably has a pour point, as measured in accordance with JIS K 2265, of −15° C. or lower, more preferably −25° C. or lower.

The lube base oil of the present invention, which satisfies the above conditions, preferably contains a compound formed of carbon atom, hydrogen atom, and oxygen atom (hereinafter referred to as "oxygen-containing compound"). Specifically, a compound having an ether structure, an ester structure, or a carbonate structure is preferred. Of these, an ether compound is particularly preferred.

The ether compound is preferably any of the compounds represented by the following formula, or a mixture thereof.

$$R^1—O—(R^2—O)_a—(R^3—O)_b—(R^4—O)_c—R^5 \quad (1)$$

In the above formula, $R^1$ and $R^5$ each independently represents hydrogen atom, an alkyl group having 1 to 24 carbon atoms, a phenyl group, or an alkylaryl group having 7 to 24 carbon atoms; $R^2$, $R^3$, and $R^4$ each independently represents an alkylene group having 2 to 18 carbon atoms; each of a, b, and c is 0 to 8 (preferably 0 to 5) as an averaged value; the sum of a to c is 0 to 8 (preferably 0 to 5); and the units ($R^2$—O), ($R^3$—O), and ($R^4$—O) may be identical to or different from one another.

The alkyl group represented by $R^1$ or $R^5$ may be linear, branched, or cyclic. Examples of the alkyl group include methyl group, ethyl group, propyl group, butyl group, hexyl group, 2-ethylhexyl group, 3,5,5-trimethylhexyl group, heptyl group, octyl group, 3,7-dimethyloctyl group, nonyl group, 2-pentylnonyl group, decyl group, 2-octylundecanyl group, dodecyl group, cyclopentyl group, and cyclohexyl group. Among them, 2-ethylhexyl group, 3,5,5-trimethylhexyl group, octyl group, 3,7-dimethyloctyl group, nonyl group, 2-pentylnonyl group, decyl group, and 2-octylundecanyl group are particularly preferred.

Examples of the alkylaryl group represented by $R^1$ or $R^5$ include alkylphenyl group and alkylnaphthyl group. Exampled of the alkyl moiety of the alkylaryl group include the groups described above. Among them, octyl group, decyl group, and dodecyl group are particularly preferred.

The alkylene group represented by $R^2$, $R^3$, or $R^4$ may be linear, branched, or cyclic. Examples of the alkylene group include ethylene group, propylene group, butylene group, hexylene group, nonylene group, decylene group, dodecylene group, cyclopentylene group, and cyclohexylene group. Of these, ethylene group, propylene group, butylene group, hexylene group, nonylene group, and decylene group are particularly preferred.

The lube base oil of the present invention may contain, in addition to the oxygen-containing compound, a hydrocarbon compound, so long as the lube base oil satisfies the above-mentioned conditions (i) to (iii).

No particular limitation is imposed on the hydrocarbon compound to be mixed with the oxygen-containing compound, so long as the hydrocarbon compound does not impair the effects of the lube base oil of the present invention. Examples of the hydrocarbon compound include mineral oils (e.g., 80 neutral mineral oils), poly(α-olefin) (e.g., viscosity grade 4 $mm^2/s$ or 8 $mm^2/s$ (100° C.)), ethylene-propylene copolymers, and alkylbenzenes (e.g., propylbenzene and butylbenzene). Of these, poly(α-olefin) is preferred.

The lube base oil of the present invention excludes silicone oil. The reason for exclusion is that, even though silicon oil satisfies the aforementioned requirements, silicon oil exhibits poor lubricity and is expensive.

The lube base oil of the present invention may be blended with a variety of additives in accordance with uses including engine use, thereby providing a lubricating oil composition. The lube base oil of the present invention per se may serve as a lube oil. However, preferably, the lube base oil is blended with any of the following additives, to thereby form a lubricating oil composition, and the composition is employed as a lube oil suited for any of the uses.

Any known additives may be used as the aforementioned additives. Examples the antioxidant include amine compounds such as alkylated dipheylamine and phenyl-α-naphthylamine and phenol compounds such as 2,6-di-tert-butylphenol, 4,4'-methylenebis (2,6-di-tert-butylphenol). Examples of the viscosity index improver include poly(methyl methacrylate)-based, polyisobutylen-based, ethylene-propylene copolymer-based, styrene-isoprene copolymer-based, and styrene-butadiene hydrogenated copolymer-based improvers. Examples of the detergent dispersant include metallic detergents such as alkaline earth metal sulfonates, alkaline earth metal phenates, alkaline earth metal salicylates, and alkaline earth metal phosphonates and ash-free dispersants such as alkenylsuccinimides, benzylamines, alkylpolyamines, and alkenylsticcinic esters. Examples of the friction reducing agent include aliphatic alcohols, fatty acids, fatty acid esters, aliphatic amines, aliphatic amine salts, aliphatic acid amides. Examples of the metal inactivator include benzotroazole, thiadiazole, and alkenylsuccinic acid esters. Examples of the pour point depressant include polyalkyl metacrylate, and polyalkylstyrene. Examples of the, antiwear agent include organic molybdenum compounds such as MoDTP and MODTC; organic zinc compounds such as ZnDTP; organic boron compounds such as alkylmercaptyl borate, and solid lubricant antiwear agents such as graphite, molybdenum disulfide, antimony sulfide, boron compounds, and polytetrafluoroethylene. Examples of the defoamer include dimethylpolysiloxane and polyacrylates. Examples of the extreme-pressure additive include sulfurized fats and oils, diphenyl sulfide, methyl trichlorostearate, and chlorinated naphthalene.

The lube base oil of the present invention is applicable to a variety of uses. Examples include internal combustion engines, hydraulic oil, automatic transmission fluid, manual transmission fluid, bumper oil, gear oil, hydraulic bearing oil, roll bearing oil, oil retaining bearing oil, sliding surface oil, and refrigerator oil.

The present invention will be described more specifically with reference to examples in the following. However, the present invention is not limited to the examples.

Characteristics of the lube base oil were determined as follows.

(1) Kinematic Viscosity

Kinematic viscosity was measured in accordance with JIS K 2283 (40° C. and 100° C.).

(2) Viscosity Index

Viscosity index was measured in accordance with JIS K 2283.

(3) Pour point

Pour point was measured in accordance with JIS K 2269.

(4) Aniline point

Aniline point was measured in accordance with JIS K 2256.

(5) Evaporation loss

Evaporation loss was measured in accordance with ASTM D 5800 (Noack test: 250° C., 1 hr).

(6) Flash point

Flash point was measured in accordance with JIS K 2265.

PRODUCTION EXAMPLE 1

2-Octyl-1-dodecanol (300 g), 1-bromooctane (300 g), tetrabutylammonium bromide (30 g), and an aqueous sodium hydroxide solution (500 g) (sodium hydroxide (150 g) dissolved in water (350 g)) were placed in a 2-L glass flask, and the mixture was allowed to react under stirring for 20 hours at 50° C.

After completion of reaction, the reaction mixture was transferred to a separating funnel, and the aqueous layer was separated through filtration. The remaining organic layer was washed five times with water (500 mL). The organic layer was distilled under reduced pressure, to thereby separate a compound.

Figure 2:
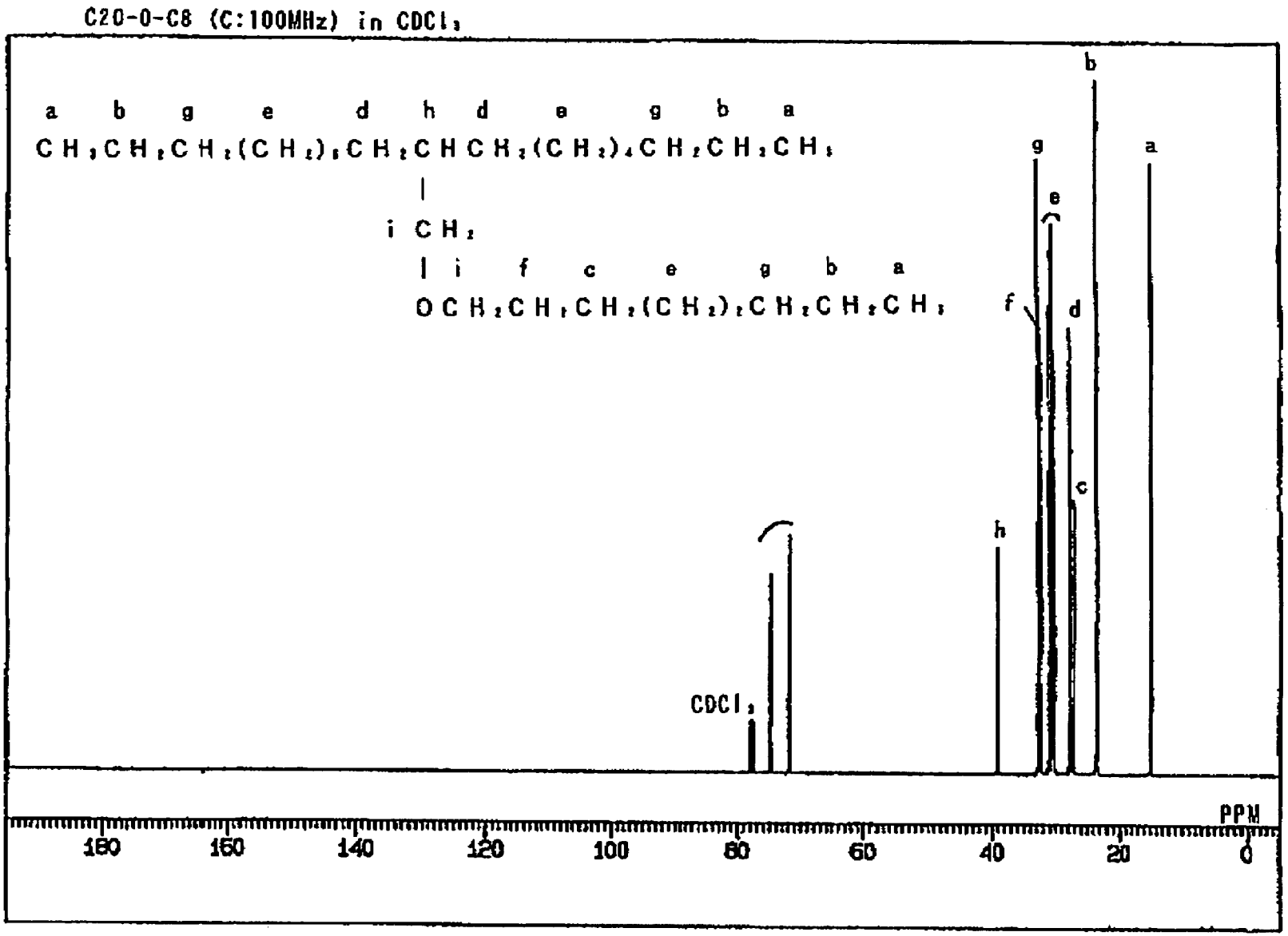
FIG. 2 shows a $^{13}$C-NMR spectrum of the compound produced in Production Example 1.

The purity of the compound was determined by means of a gas chromatography analyzer (analyzer: Model Hitachi 263-70, column: OV-1 packed column (product of GL Science Inc.) (2 m)) to be 99% or higher (as calculated based on peak area). The compound was identified as an ether compound having a structure represented by the following formula by means of nuclear magnetic resonance apparatus ($^{1}$H-NMR, $^{13}$C-NMR: GSX400, product of JOEL Ltd.). FIGS. 1 and 2 show the obtained $^{1}$H-NMR and $^{13}$C-NMR spectra, respectively.

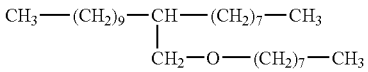

PRODUCTION EXAMPLE 2

The procedure, including reaction and post-treatment, of Production Example 1 was repeated, except that 2-decyl-1-dodecanol (95%) (326 g) and 1-bromoheptane (197 g) were employed instead of 2-octyl-1-dodecanol (300 g) and 1-bromooctane (300 g), respectively, to thereby yield a compound. The structure of the compound was analyzed in a manner similar to that employed in Production Example 1, thereby identifying the compound to be an ether compound having a structure represented by the following formula.

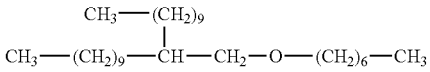

PRODUCTION EXAMPLE 3

The procedure, including reaction and post-treatment, of Production Example 1 was repeated, except that 2-decyl-1-tetradecanol (354 g) and 1-bromoheptane (200 g) were employed instead of 2-octyl-1-dodecanol (300 g) and 1-bromooctane (300 g), respectively, to thereby yield a compound. The structure of the compound was analyzed in a manner similar to that employed in Production Example 1, thereby identifying the compound to be an ether compound having a structure represented by the following formula.

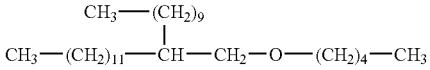

PRODUCTION EXAMPLE 4

The procedure, including reaction and post-treatment, of Production Example 1 was repeated, except that 2-hexyl-1-dodecanol (92%) (190 g) and 1-bromodecane (244 g) were employed instead of 2-octyl-1-dodecanol (300 g) and 1-bromooctane (300 g), respectively, to thereby yield a compound. The structure of the compound was analyzed in a manner similar to that employed in Production Example 1, thereby identifying the compound to be an ether compound having a structure represented by the following formula.

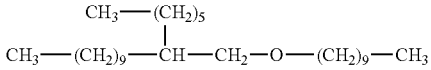

PRODUCTION EXAMPLE 5

The procedure, including reaction and post-treatment, of Production Example 1 was repeated, except that 2-hexyl-1-decanol (242 g) and 1-bromodecane (244 g) were employed instead of 2-octyl-1-dodecanol (300 g) and 1-bromooctane (300 g), respectively, to thereby yield a compound. The structure of the compound was analyzed in a manner similar to that employed in Production Example 1, thereby identifying the compound to be an ether compound having a structure represented by the following formula.

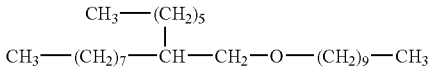

PRODUCTION EXAMPLE 6

2-Butyl-1-octanol (204 g), 1,4-dibromobutane (108 g), tetrabutylammonium bromide (15.6 g), and an aqueous sodium hydroxide solution (sodium hydroxide (240 g) dissolved in water (220 g)) were placed in a 1-L glass flask, and the mixture was allowed to react under stirring for 48 hours at 70° C. The reaction mixture was post-treated in a manner similar to that employed in Production Example 1, thereby yielding 54 g of a distilled product. The structure of the product was analyzed, thereby identifying the product to be an ether compound having a structure represented by the following formula.

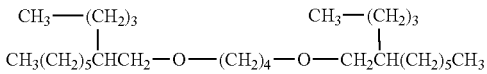

PRODUCTION EXAMPLE 7

2-Hexyl-1-decanol (121 g), diethylaniline (61 g), and diethyl ether (150 mL) were placed in a 500-mL glass flask, and the mixture was stirred. Octanoyl chloride (82 g) was slowly added dropwise to the mixture under stirring. After the mixture had been stirred for five hours, the ether layer was separated, washed four times with 10% sulfuric acid (100 mL), washed with water, and dried over Glauber's salt, followed by removing ether.

The organic layer was distilled under reduced pressure, to thereby yield 82 g of a distilled product. The structure of the product was analyzed in a manner similar to that employed in Production Example 1, thereby identifying the product to be an ether compound having a structure represented by the following formula.

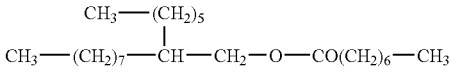

PRODUCTION EXAMPLE 8

3-Methylpentanediol (59 g), diethylaniline (120 g), and ether (200 mL) were placed in a 500-mL glass flask, and the mixture was stirred. Octanoyl chloride (162 g) was slowly added dropwise to the mixture under stirring. After the mixture was stirred for five hours, the ether layer was separated, washed four times with 10% sulfuric acid (100 mL), washed with water, and dried over Glauber's salt, followed by removing ether.

The organic layer was distilled under reduced pressure, to thereby yield 48 q of a distilled product. The structure of the product was analyzed in a manner similar to that employed in Production Example 1, thereby identifying the product to be an ether compound having a structure represented by the following formula.

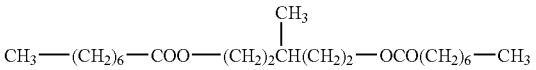

EXAMPLE 1

The compound obtained in Production Example 1 was measured in terms of the characteristics (1) to (6) mentioned above. The results are shown in Table 1.

EXAMPLE 2

The compound obtained in Production Example 2 was measured in terms of the characteristics (1) to (6) mentioned above. The results are shown in Table 1.

EXAMPLE 3

The compound obtained in Production Example 3 was measured in terms of the characteristics (1) to (6) mentioned above. The results are shown in Table 1.

EXAMPLE 4

The compound obtained in Production Example 4 was measured in terms of the characteristics (1) to (6) mentioned above. The results are shown in Table 1.

EXAMPLE 5

The compound obtained in Production Example 5 was measured in terms of the characteristics (1) to (6) mentioned above. The results are shown in Table 1.

EXAMPLE 6

The compound obtained in Production Example 6 was measured in terms of the characteristics (1) to (6) mentioned above. The results are shown in Table 1.

EXAMPLE 7

The compound obtained in Production Example 7 was mixed with poly(α-olefin) (tradename: HITEC 164, product of ETHYL) at a ratio by mass of 1:1. The mixture was measured in terms of the characteristics (1) to (6) mentioned above. The results are shown in Table 1.

EXAMPLE 8

The compound obtained in Production Example 8 was mixed with poly(α-olefin) (tradename: HITEC 164, product of ETHYL) at a ratio by mass of 2:3. The mixture was measured in terms of the characteristics (1) to (6) mentioned above. The results are shown in Table 1.

COMPARATIVE EXAMPLE 1

Di(2-ethylhexyl) sebacate (product of Tokyo Kasei Kogyo Co., Ltd.) was measured in terms of the characteristics (1) to (6) mentioned above. The results are shown in Table 1.

COMPARATIVE EXAMPLE 2

Di(2-ethylhexyl) adipate (product of Tokyo Kasei Kogyo Co., Ltd.) was measured in terms of the characteristics (1) to (6) mentioned above. The results are shown in Table 1.

COMPARATIVE EXAMPLE 3

Di(2-ethylhexyl) adipate (product of Tokyo Kasei Kogyo Co., Ltd.) (50 mass %) was mixed with poly(α-olefin) (tradename: HITEC 164, product of ETHYL) (50 mass %). The mixture was measured in terms of the characteristics (1) to (6) mentioned above. The results are shown in Table 1.

COMPARATIVE EXAMPLE 4

Poly(α-olefin) (tradename: HITEC 164, product of ETHYL) was measured in terms of the characteristics (1) to (6) mentioned above. The results are shown in Table 1.

TABLE 1

| | Kinematic viscosity ($mm^2/s$) | | Viscosity | Pour point | Aniline point | Evaporation loss | Flash point | Density |
|---|---|---|---|---|---|---|---|---|
| | 40° C. | 100° C. | index | (° C.) | (° C.) | (mass %) | (° C.) | ($g/cm^3$) |
| Ex. 1 | 9.807 | 2.804 | 137 | −37.5 | 90.7 | 24.7 | 228 | 0.8278 |
| Ex. 2 | 11.240 | 3.051 | 134 | −35.0 | 87.2 | 23.8 | 232 | 0.8301 |

TABLE 1-continued

| | Kinematic viscosity ($mm^2/s$) | | Viscosity | Pour point | Aniline point | Evaporation loss | Flash point | Density |
|---|---|---|---|---|---|---|---|---|
| | 40° C. | 100° C. | index | (° C.) | (° C.) | (mass %) | (° C.) | ($g/cm^3$) |
| Ex. 3 | 11.960 | 3.169 | 133 | −20.0 | 85.5 | 22.6 | 234 | 0.8304 |
| Ex. 4 | 9.744 | 2.771 | 132 | −35.0 | 85.9 | 24.9 | 226 | 0.8278 |
| Ex. 5 | 8.372 | 2.494 | 129 | −45 or lower | 86 | 27.3 | 211 | 0.8283 |
| Ex. 6 | 10.810 | 2.829 | 107 | −45 or lower | 62 | 22.4 | 238 | 0.8475 |
| Ex. 7 | 11.300 | 3.029 | 128 | −50 or lower | 65 | 25.7 | 215 | 0.8385 |
| Ex. 8 | 11.830 | 3.195 | 141 | −42.5 | 62 | 28.4 | 218 | 0.8572 |
| Comp. Ex. 1 | 11.600 | 3.200 | 149 | −50 or lower | −20 or lower | — | 215 | — |
| Comp. Ex. 2 | 7.643 | 2.310 | 115 | −50 or lower | — | 40.9 | — | 0.9291 |
| Comp. Ex. 3 | 10.790 | 2.909 | 122 | −50 or lower | 71.8 | 38.1 | — | 0.8695 |
| Comp. Ex. 4 | 16.700 | 3.840 | 124 | −50 or lower | 120 | 11.8 | 213 | — |

INDUSTRIAL APPLICABILITY

As described hereinabove, the lube base oil and the lubricating oil composition of the present invention attain excellent fuel-cost-saving effect by virtue of low viscosity, a long service life by virtue of a small evaporation loss, and excellent compatibility with organic materials. Thus, the lube base oil and the lubricating oil composition are useful for engine oil for use in internal combustion engines, and lubricating oils such as bearing oils.

The invention claimed is:

1. A lube base oil other than silicone oil having a kinematic viscosity of 12 $mm^2/s$ or below at 40° C., exhibiting, in Noack test (250° C., 1 hr), an evaporation loss of 30 mass % or below and/or a flash point of 200° C. or higher, exhibiting an aniline point of 60° C. or higher, and comprising any of the ether compounds represented by the following formula, or a mixture thereof:

$$R^1—O—(R^2—O)_a—(R^3—O)_b—(R^4—O)_c—R^5 \quad (1)$$

wherein $R^1$ and $R^5$ each independently represents hydrogen atom, an alkyl group having 1 to 24 carbon atoms, a phenyl group, or an alkylaryl group having 7 to 24 carbon atoms; $R^2$, $R^3$, and $R^4$ each independently represents an alkylene group having 2 to 18 carbon atoms; each of a, b, and c is 0 to 8 as an averaged value; the sum of a to c is 0 to 8; and the units ($R^2$—O), ($R^3$—O), and ($R^4$—O) may be identical to or different from one another.

2. A lube base oil as described in claim 1, which exhibits an aniline point of 80° C. or higher.

3. A lube base oil as described in claim 1, which exhibits a flash point of 220° C. or higher.

4. A lube base oil as described in claim 1, which has a kinematic viscosity of 10 $mm^2/s$ or below at 40° C.

5. A lube base oil as described in claim 1, which further contains a hydrocarbon compound.

6. A lube base oil as described in claim 5, wherein the hydrocarbon compound is a poly(α-olefin).

7. A lube base oil as described in claim 1, wherein each of a, b, and c is 0 to 5 as an averaged value; the sum of a to c is 0 to 5.

8. A lube base oil as described in claim 1, wherein b and c are 0 in said formula (1).

9. A lube base oil as described in claim 1, wherein a, b and c are 0 in said formula (1).

10. A lube base oil as described in claim 1, which exhibits an evaporation loss of 30 mass % or below.

11. A lube base oil as described in claim 1, which exhibits a flash point of 200° C. or higher.

12. A lube base oil as described in claim 1, which exhibits an evaporation loss of 15 mass % or below.

13. A lube base oil as described in claim 1, which exhibits an aniline point of 90° C. to 110° C.

14. A lube base oil as described in claim 1, which exhibits a viscosity index of 120 or higher.

15. A lube base oil as described in claim 1, which exhibits a pour point of −20° C. or lower.

16. A lubricating oil composition comprising a lube base oil as recited in claim 1, mixed with at least one additive selected from the group consisting of an antioxidant, a viscosity index improver, a detergent dispersant, a friction reducing agent, a metal inactivator, a pour point depressant, an abrasion resisting agent, a defoamer, and an extreme-pressure additive.

* * * * *